US010597228B1

(12) United States Patent
Yao

(10) Patent No.: US 10,597,228 B1
(45) Date of Patent: Mar. 24, 2020

(54) MAGNETIC DRIVE INTELLIGENT TRASH BIN LID ASSEMBLY

(71) Applicant: Hinab Investment LLC, Pomona, CA (US)

(72) Inventor: Qiang Yao, Guangdong (CN)

( * ) Notice: Subject to any disclaimer, the term of this patent is extended or adjusted under 35 U.S.C. 154(b) by 0 days.

(21) Appl. No.: 16/271,684

(22) Filed: Feb. 8, 2019

(51) Int. Cl.
*B65F 1/16* (2006.01)

(52) U.S. Cl.
CPC ..... *B65F 1/1638* (2013.01); *B65F 2210/168* (2013.01)

(58) Field of Classification Search
CPC ..... B65F 1/16; B65F 1/1623
USPC ..... 318/266
See application file for complete search history.

(56) References Cited

U.S. PATENT DOCUMENTS 6,327,994 B1 * 12/2001 Labrador ..... B01D 61/10 114/382

FOREIGN PATENT DOCUMENTS

CN 208233884 U * 12/2018
KR 20120077146 A * 7/2012

* cited by examiner

*Primary Examiner* — Kawing Chan
(74) *Attorney, Agent, or Firm* — Elizabeth Yang

(57) ABSTRACT

A magnetic drive intelligent trash bin lid assembly automatically opens and closes a lid portion relative to a trash container. The lid portion comprises a shell that pivotally joins the container at a lid shaft. A sensor detects motion near the lid, and activates a drive motor in response. The drive motor powers an output shaft to rotate and engages a magnetic clutch. The magnetic clutch includes two magnets that are released from their respective seats to attract each other; and thereby axially displace the output shaft into engagement with a variable linkage. The magnetic clutch engages and disengages the drive motor and the variable linkage, allowing the variable linkage to articulate independently of the drive motor. This separation reduces excessive loads as the lid portion articulates between open and closed positions. A spring absorbs forces in the magnetic clutch, so as to reduce axial loads in the magnetic clutch.

20 Claims, 5 Drawing Sheets

MAGNETIC DRIVE INTELLIGENT TRASH BIN LID ASSEMBLY

FIELD OF THE INVENTION

The present invention relates generally to a magnetic drive intelligent trash bin lid assembly. More so, the present invention relates to a trash bin lid that is operable with a container to automatically open and close a lid portion relative to a trash container; whereby the lid portion comprises a shell that pivotally joins the container at a lid shaft; whereby a sensor detects motion near the lid, and activates a drive motor in response; whereby the drive motor powers an output shaft to rotate and engages a magnetic clutch; whereby the magnetic clutch includes two magnets that are released from their respective seats to attract each other, and thereby axially displace the output shaft into engagement with a variable linkage; whereby the magnetic clutch engages and disengages the drive motor and the variable linkage, allowing the variable linkage to articulate independently of the drive motor, so as to reduce excessive loads as the lid portion articulates between open and closed positions; and whereby a spring absorbs forces in the magnetic clutch, so as to reduce axial loads in the magnetic clutch.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, trash bins act as containers for holding trash and other wastes that are produced in any typical home or office. Trash and garbage cans often employ lids and covers to contain the trash and its associated odor, to hide the trash from view, and to prevent the trash from contaminating areas beyond the lid. Conventional trash cans have been improved over the years to make them more user-friendly, sanitary, and hygienic. For example, many trash cans are now provided with a sensor that is positioned on the lid. The sensor is activated by infrared when the user waves a hand near the sensor, and the activation will cause the lid to open. However, these conventional trash cans still suffer from a number of drawbacks.

In many instances, household appliances with intelligent automation are in high demand, so various kinds of sensor trash cans have emerged. Typically, these sensor trash cans use variable-phase motors to drive gearboxes or variable-direction link drive. During the daily use, the close clearance between the components in the structure causes a certain loss to the gearbox or the variable link drive.

When the drive gearboxes or variable-direction link drives of the trash bin encounter an unreasonable high-intensity repeated opening and closing (when the child is playing with it), it will cause high-intensity load on the whole drive structure, resulting in damage to the motor and gearboxes or the variable link drive. Under these circumstances, it will affect the normal use and need to be improved.

Other proposals have involved automated trash bins. The problem with these is that the gear and linkages are stressed with heavy loads from repetitive opening and closing. This causes them to break frequently. Even though the above cited automated trash bins meet some of the needs of the market, a magnetic drive intelligent trash bin lid assembly. More so, the present invention relates to a trash bin lid that is operable with a container to automatically open and close a lid portion relative to a trash container; whereby the lid portion comprises a shell that pivotally joins the container at a lid shaft; whereby a sensor detects motion near the lid, and activates a drive motor in response; whereby the drive motor powers an output shaft to rotate and engages a magnetic clutch; whereby the magnetic clutch includes two magnets that are released from their respective seats to attract each other, and thereby axially displace the output shaft into engagement with a variable linkage; whereby the magnetic clutch engages and disengages the drive motor and the variable linkage, allowing the variable linkage to articulate independently of the drive motor, so as to reduce excessive loads as the lid portion articulates between open and closed positions; and whereby a spring absorbs forces in the magnetic clutch, so as to reduce axial loads in the magnetic clutch, is still desired.

SUMMARY

Illustrative embodiments of the disclosure are generally directed to a magnetic drive intelligent trash bin lid assembly. The trash bin lid assembly operates a lid of a trash bin with minimal load on the motor, linkages, transmission, and other components, through use of a magnetic clutch and spring that absorb excess load.

In some embodiments, the trash bin lid assembly may include a lid portion hingedly attachable to a container portion used to receive and store trash. The lid portion comprises a shell with a shell cover. The shell is selectively pivotable in a generally arcuate path about the container portion through a variable linkage comprising a shaft, a lid shaft that passes through a crankshaft, and a lid shaft inserted into a cover seat.

A drive motor works to drive the lid portion between an open position and a closed position based upon sensory signal transmitted by a sensor, or a switch on the lid portion or container portion. The power drive may be operatively attached to the sensor or the switch. A rotatable output shaft extends from the drive motor, passing through the magnetic clutch, described below, and selectively coupling to an elastic seat.

A magnetic clutch engages and disengages the drive motor and the variable linkage from each other, allowing the variable linkage to articulate independently of the drive motor. This separation ensures that the drive motor will not be subjected to excessive load under the external force of articulating the shell of the lid portion between the open and closed positions.

The magnetic clutch comprises a first magnet positioned in a magnet front seat, a second magnet positioned in a rear seat, and the aforementioned elastic seat. The magnets and elastic seat are coaxially arranged in an adjacent, coaxial configuration. The magnets are urged to disengage their magnetic attraction, or released to magnetically attract.

The assembly further includes a spring. Then spring is defined by two ends that are disposed between the magnet rear seat and the elastic seat. The two ends of the spring are respectively inserted into the opening of the magnet rear seat and the elastic seat. The spring generates a spring tension that absorbs forces in the magnetic clutch.

When the sensor detects motion or when the switch is engaged, the drive motor is activated, causing the output shaft to rotate. Further, the first and second magnets are released from their respective seats, causing the magnets to attract each other. This attraction axially displaces the elastic seat towards the output shaft, creating a coupling with the output shaft of the drive motor. The spring reduces structural stress from the displacement of the elastic seat against the output shaft.

The rotatable shaft that extends from the elastic seat engages the crankshaft of the variable linkage. Consequently, the crankshaft turns the lid shaft, which rotates a lid shaft inserted into a cover seat in the shell. The shell is then forced to pivot in a generally arcuate path to the open position.

Conversely, when the sensor does not detect motion or when the switch is disengaged, the drive motor is powered off and the magnets return to their respective seats, causing the magnets to disengage. This allows the output shaft to release from the elastic seat, and the rotatable shaft to disengage from the crankshaft of the variable linkage. The shell is then released to pivot to the closed position.

One objective of the present invention is to engage and disengage the drive motor from the variable linkage with a magnetic clutch to ensure that the motor will not be subjected to load under the external force.

Another objective is to provide additional springs at the elastic seat to reduce the structural stress in the magnetic clutch and effectively protect the entire transmission structure.

Another objective is to reduce stressful loads for high-intensity repeated opening and closing of the lid portion.

Another objective is to provide a sensor or a switch that automates the articulation of the shell between the open and closed positions.

Yet another objective is to greatly extend the service life of the trash bin apparatus, so as to make it more practical.

Yet another objective is to provide a simple structure, having reasonable settings, and low cost.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1:
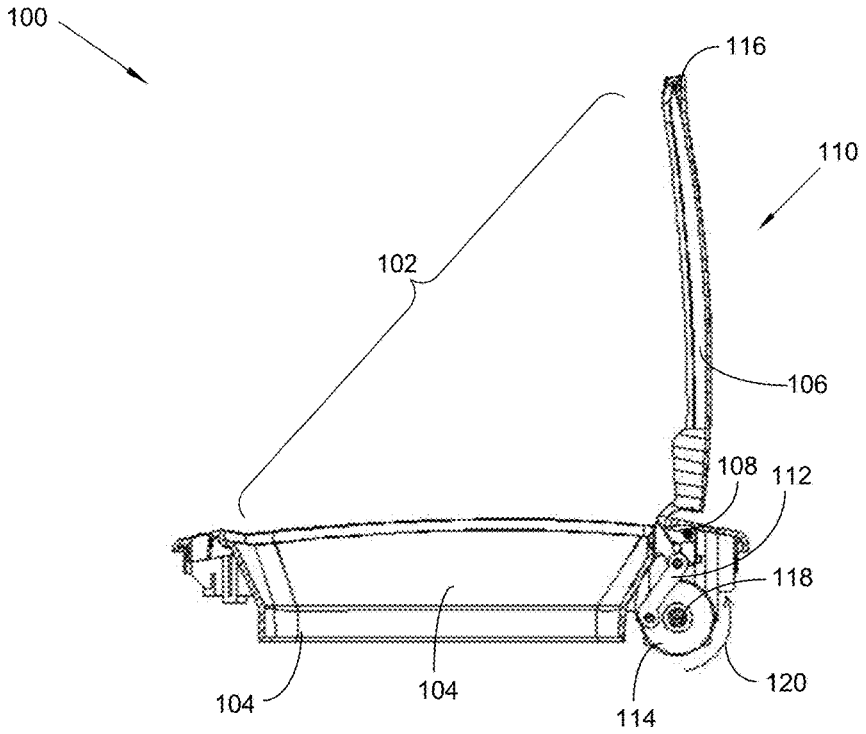
FIG. 1 illustrates a left side view of an exemplary magnetic drive intelligent trash bin lid assembly in an open position, in accordance with an embodiment of the present invention.
Figure 2:
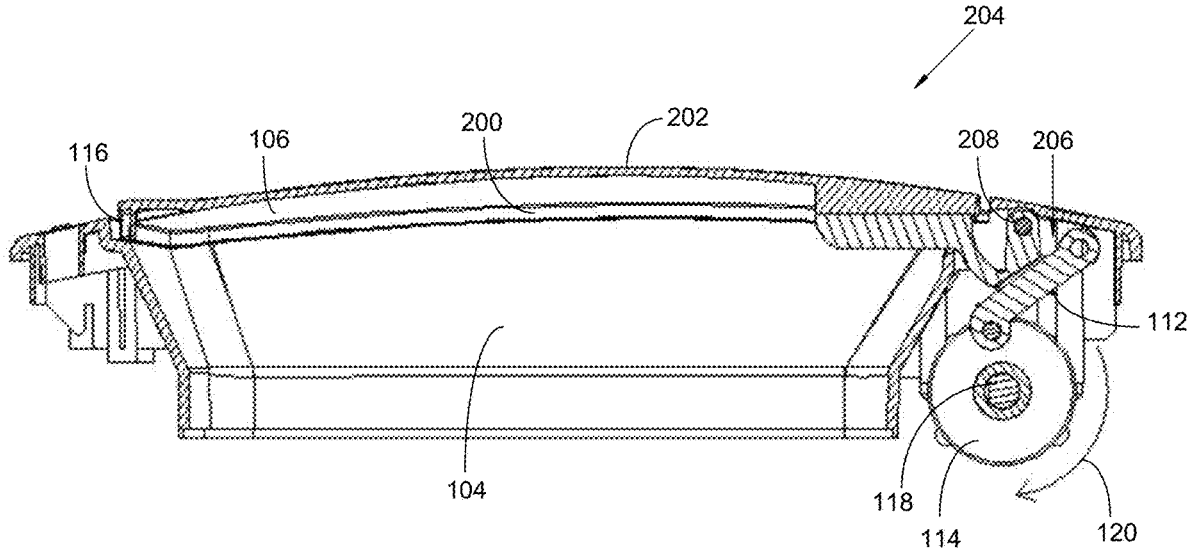
FIG. 2 illustrates a left side view of the magnetic drive intelligent trash bin lid assembly shown in FIG. 1, in a closed position, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A magnetic drive intelligent trash bin lid assembly 100 is referenced in FIGS. 1-8. The magnetic drive intelligent trash bin lid assembly 100, hereafter "assembly 100" provides is configured to automatically open and close a lid portion 102 relative to a trash container. The lid portion 102 comprises a shell 104 that pivotally joins the container at a lid shaft. A sensor 116 detects motion near the lid, and activates a drive motor 114 in response. The drive motor 114 powers an output shaft 118 to rotate and engages a magnetic clutch 500.

The magnetic clutch 500 includes two magnets 600, 604 that are released from their respective seats 602, 606 to attract each other; and thereby axially displace the output shaft 118 into engagement with a variable linkage 206. The magnetic clutch 500 is configured to engage and disengages the drive motor 114 and the variable linkage 206, allowing the variable linkage 206 to articulate independently of the drive motor 114. This separation reduces excessive loads as the lid portion 102 articulates between open and closed positions 110, 204. A spring 610 absorbs forces in the magnetic clutch 500, so as to reduce axial loads in the magnetic clutch 500.

As referenced in FIG. 1, the assembly 100 comprises a lid portion 102 that operates with a container portion (not shown). The lid portion 102 may include a gate or cap that automatically opens and closes over an opening in the container portion, so as to regulate access thereto. The container portion may include an elongated container known in the art to receive and store trash. The lid portion 102 comprises a shell 104 having a lid shaft 108, a bottom 200, and a top 202, with the top being visible when the shell is operable. In some embodiments, a shell cover 106 joins to the shell 104, forming a covering over an opening in the shell 104. The shell cover 106 is screwed to the shell 104 by a lid shaft 108.

In some embodiments, the lid shaft 108 enables pivotal articulation of the shell. The shell 104 selectively pivots about the lid shaft 108 in an arcuate path between an open position 110 (FIG. 1) and a closed position 204 (FIG. 2) relative to a container portion. Two ends 616*a*, 616*b* of the lid shaft 108 are inserted into a left cover sleeve 620 and a right cover sleeve 622. The left cover sleeve 620 is defined by a left vertical side 624*a* and a left lateral side 624*b*. The right cover sleeve 622 is defined by a right vertical side 626*a* and a right lateral side 626*b*. In some embodiments, the vertical sides 624*a*, 626*a* are inserted into multiple slots in the shell 104. The left cover sleeve and the right lateral side 626*b* of the right cover sleeve 622 are fixed by screws in a second column 806 on the bottom 200 of the shell 104.

Figure 3:
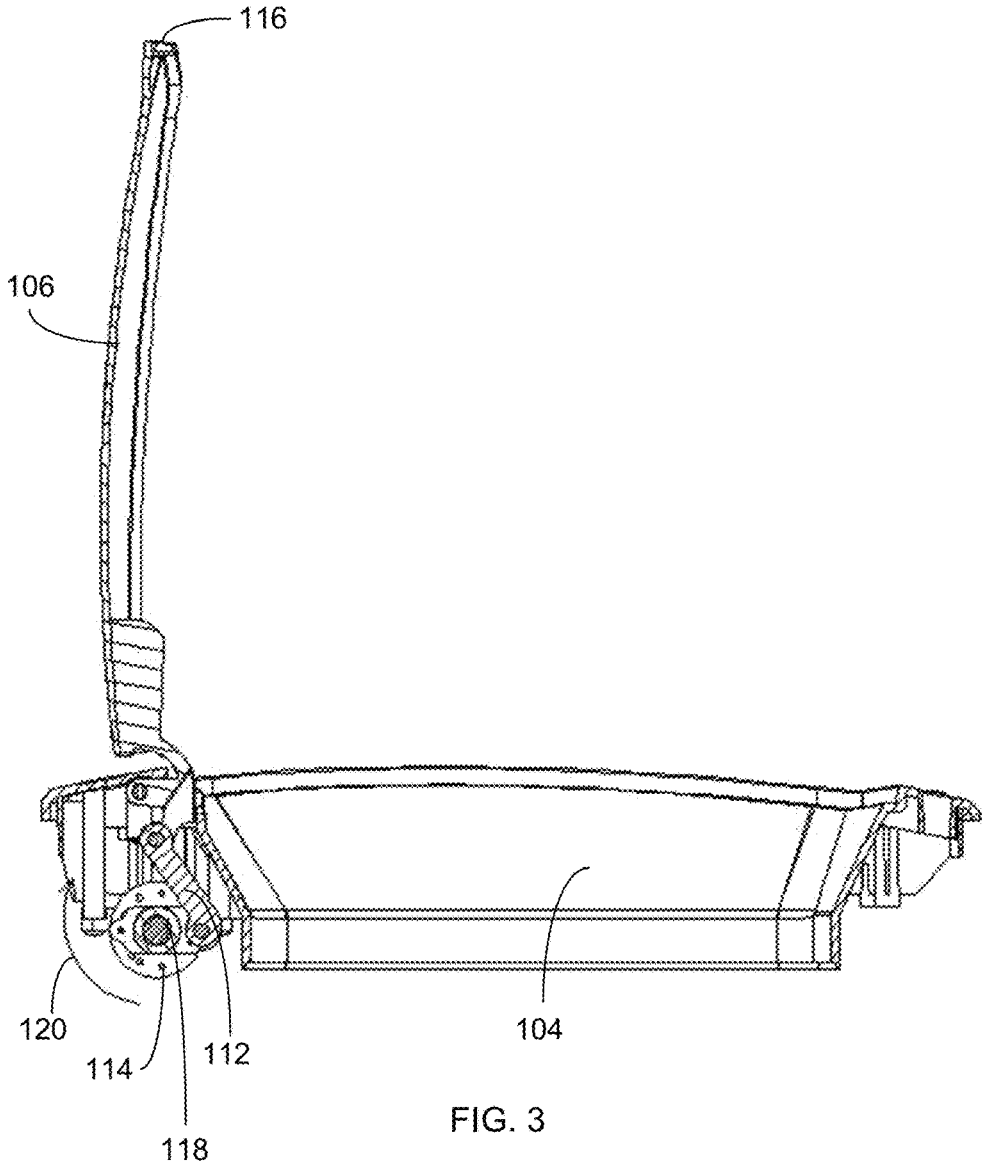
FIG. 3 illustrates a right side view of the magnetic drive intelligent trash bin lid assembly shown in FIG. 1, in an open position, in accordance with an embodiment of the present invention.
Figure 4:
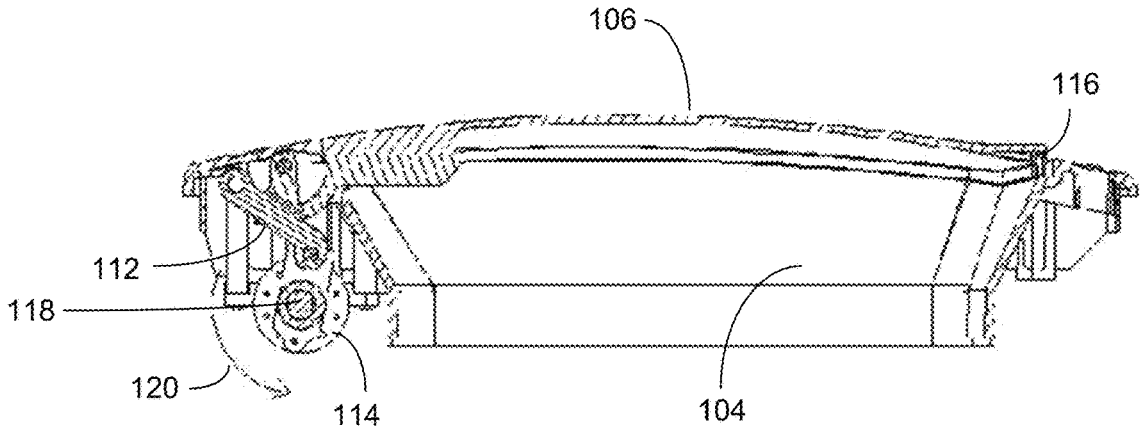
FIG. 4 illustrates a right side view of the magnetic drive intelligent trash bin lid assembly shown in FIG. 1, in a closed position, in accordance with an embodiment of the present invention.

As FIGS. 3 and 4 illustrate, the assembly 100 may also include a variable linkage 206 connected to the shell 104. The variable linkage 206 enables the articulating motion of the shell 104 and shell cover 106 to progress efficiently. The variable linkage 206 includes a shaft 208; a crankshaft 112; and the lid shaft. A cover seat 802 from the variable linkage 206 receives the lid shaft. The lid shaft is disposed to insert into the cover seat 802.

Figure 5:
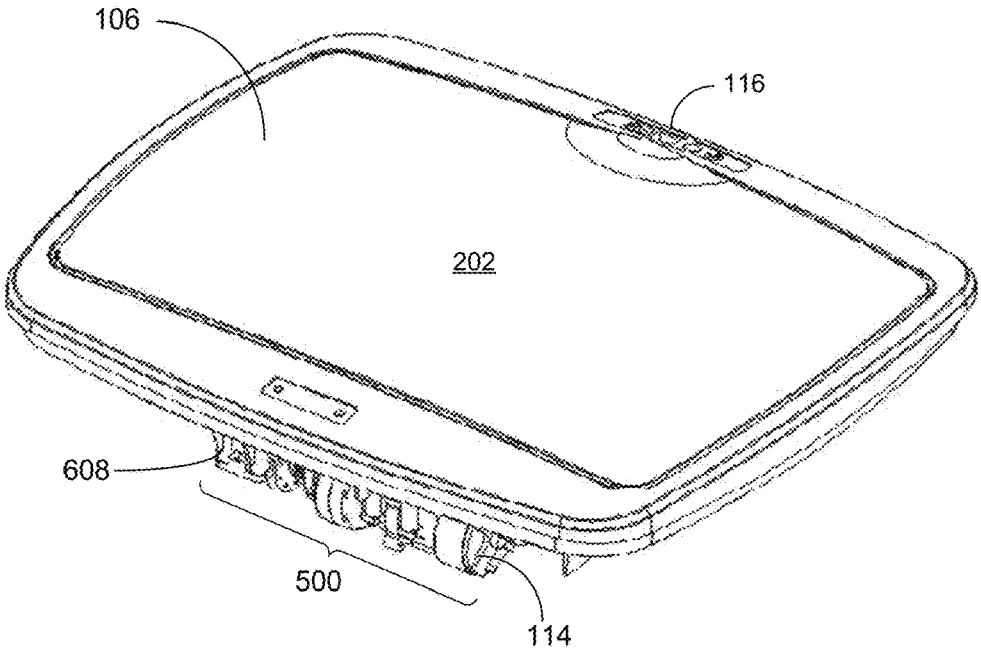
FIG. 5 illustrates a top perspective view of the magnetic drive intelligent trash bin lid assembly, in accordance with an embodiment of the present invention.

Turning now to FIG. 5, the assembly 100 provides a drive motor 114 for powering the pivotal articulation of the shell 104. The drive motor 114 comprises a rotatable output shaft 118. The drive motor 114 is operable to rotate the rotatable output shaft 118. The assembly 100 also utilizes a motor 820 and a speed reducer 822 that connect to the output shaft 118. The drive motor 114 is fixed in the third column 808 on the bottom 200 of the shell 104 through at least one screw 614. In some embodiments, the output shaft 118 may be defined by an outer end 612 that is screwed into the elastic seat 608. In this manner, the magnet front seat is fixed with the output shaft 118.

Figure 6:
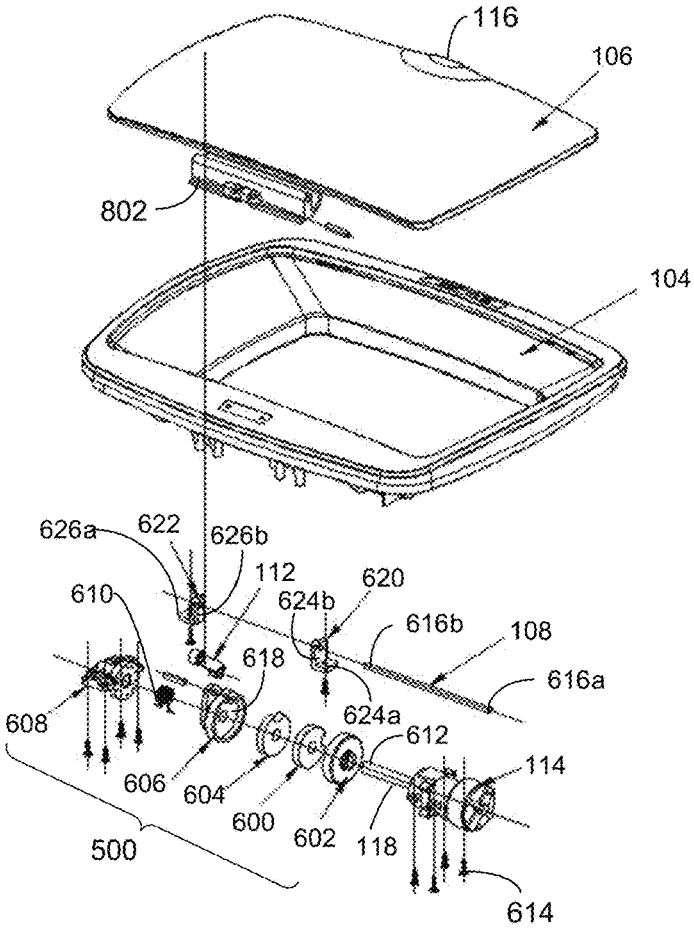
FIG. 6 illustrates a top blow up view of the magnetic drive intelligent trash bin lid assembly, showing the magnetic clutch in accordance with an embodiment of the present invention.

Turning now to FIG. 6, a sensor 116 is operatively connected to the drive motor 114. The sensor 116 is configured to detect a sensory motion near the lid portion 102. The sensor 116 activates the drive motor 114 when a sensory motion is detected. This may include a person or object that waves in an area near the lid portion 102, with the intent to displace the lid portion 102 to the open position 110. In one embodiment, the output shaft 118 rotates when the sensor 116 detects motion.

Figure 7:
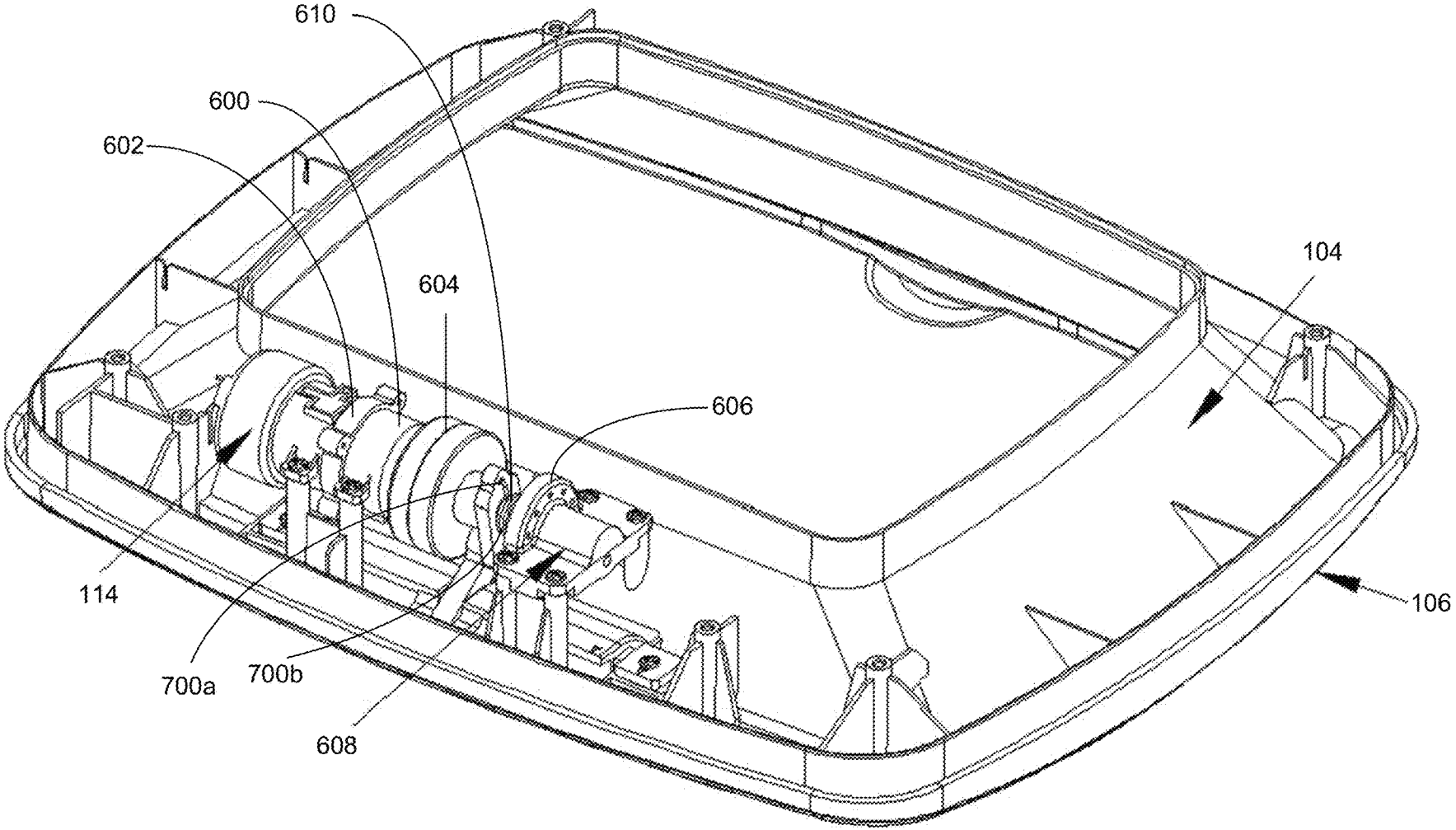
FIG. 7 illustrates a bottom perspective view of the magnetic drive intelligent trash bin lid assembly, in accordance with an embodiment of the present invention.

As shown in FIG. 7, a magnetic clutch 500 receives the output shaft 118. The magnetic clutch 500 selectively engages and disengages the drive motor 114 and the variable linkage 206. The magnetic clutch 500 may include a first magnet 600 positioned in a magnet front seat 602; and a second magnet 604 positioned in a magnet rear seat 606. In one embodiment, the first magnet 600 is clamped to a front seat post 810 of an inner wall of the magnet front seat 602 through a first gap 812. In another embodiment, the second magnet 604 is clamped to a back seat post 818 of an inner wall of the magnet rear seat 606 through a second gap 814.

Figure 8:
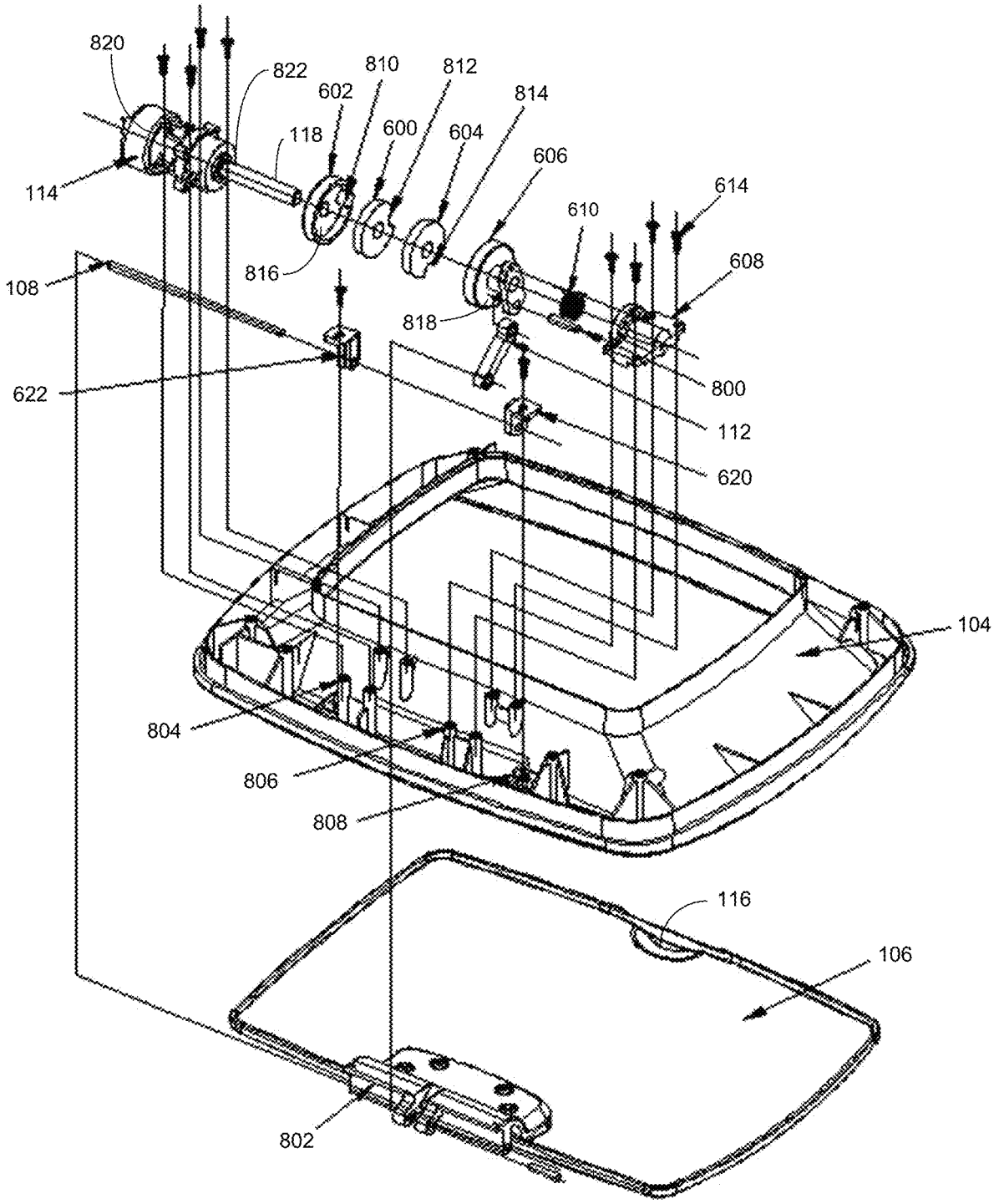
FIG. 8 illustrates a bottom blow up view of the magnetic drive intelligent trash bin lid assembly, in accordance with an embodiment of the present invention.

Additionally, FIG. 8 shows the magnetic clutch 500 having an elastic seat 608, and a rotatable shaft 800 extending from the elastic seat 608. In one embodiment, the magnet front seat 602 is clamped to the output shaft 118 of the drive motor 114. In another embodiment, the elastic seat 608 is fixed by the at least one screw 614 to a first column 804 on the bottom 200 of the shell 104. The magnets 600, 604 and the elastic seat 608 are coaxially arranged in a coaxial configuration. The magnets 600, 604 are releasable from the seats 602, 606 to magnetically attract to each other, and thereby create articulating forces for movements in the magnetic clutch 500.

Looking again at FIG. 6, the assembly 100 also provides a spring 610 that is defined by two ends 700*a*, 700*b*. The ends of the spring 610 are inserted into the magnet rear seat 606 and the elastic seat 608, respectively. The spring 610 is configured to help absorb axial and rotational forces applied to the magnetic clutch 500. The spring 610 may be axially disposed with other components of the magnetic clutch 500.

In operation, rotation of the output shaft 118 releases the first magnet 600 from the magnet front seat 602, and also releases the second magnet 604 from the magnet rear seat 606. The magnets are then free to draw together, thereby causing the elastic seat 608 to be axially displaced towards the output shaft 118. This causes the rotatable shaft to extend from the elastic seat 608 and engage the crankshaft 112.

Those skilled in the art will recognize that the crankshaft 112 must convert up-and-down, or axial motion into rotational motion 120. In this case, the crankshaft 112 converts the axial displacement along the magnetic clutch 500 to a rotational motion 120 against the lid shaft 108; thereby causing the lid shaft 108 to pivot the shell 104 to the open position 110. This powered articulation initiates with sensory motion, and terminates with the shell 104 being powered to articulate to the open position. The magnetic clutch 500 and spring 610 reduce the loads and axial force from the displacement of the elastic seat 608 towards the output shaft 118.

In releasing the lid portion 102 to the closed position 204, the opposite chain of events occur. In this operation, the cessation of rotation by the output shaft 118 engages the first magnet 600. This pushes the first magnet 600 into a first cavity 816 of the magnet front seat 602. The output shaft 118 also engages the second magnet 604, pushing the second magnet 604 into a second cavity 618 of the magnet rear seat 606. The resultant is that the first and second magnets 600, 604 withdraw from each other, overcoming their magnetic attractive forces. This causes the elastic seat 608 to be axially displaced away from the output shaft 118.

Consequently, the rotatable shaft extending 800 from the elastic seat 608 is then disengaged from the crankshaft 112, which allows the lid shaft 108 to release the shell 104 to the closed position 204. These automated motions between the open and closed positions may also be actuated by a switch on the lid portion 102, rather than a sensor 116. But in any case, the magnetic clutch 500 and the spring 610 reduce the loads when repeated opening and closing occurs.

To achieve the above objectives, the technical solution adopted by the utility model comprises a drive motor 114, a magnet front seat, a first magnet 600, a second magnet, and a magnet rear seat 606, an elastic seat 608, a crankshaft 112, a spring 610, a left cover sleeve 620, a right cover sleeve 622, a seat rotatable shaft, and a lid shaft 108.

The working principle of the implementation, as shown in FIG. 8, include: a first magnet 600 and a second magnet that attract each other the output shaft 118 of the drive motor 114, between the drive motor 114 and the crankshaft 112. The first magnet 600, the second magnet, the third magnet, and the second magnet 604 which fix the former two, constitute the magnetic clutch 500. When the drive motor 114 is in operation, the first magnet 600 rotates. Since the first magnet 600 and the second magnet 604 attract each other, the second magnet 604 also rotates, causing the crankshaft 112 connected to the magnet rear seat 606 to be rotated, and the shell 104 to be moved to the open position 110.

Since the drive motor 114 is spaced apart from the crankshaft 112, during the normal operation of the entire drive structure, the magnetic clutch 500 protects the drive motor 114 and the variable linkage 206 to reduce the loss. The crankshaft 112, the right half of the magnet rear seat 606 connected with the crankshaft 112, the spring 610, and the seat rotatable shaft, for example. Even when the high-intensity repeated opening and closing (when the child is playing with it) cover is encountered, the magnetic clutch 500 separates the motor from the variable linkage 206 independently to ensure that the drive motor 114 is not subjected to load under the external force. At the same time, even if the surface cover is swung under the external force the added spring 610 acts as a buffer to greatly reduce the structural stress, effectively protect the entire drive structure and greatly extend the service life of the assembly 100.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A magnetic drive intelligent trash bin lid assembly, the assembly comprising:

a lid portion having:

a shell having a lid shaft, a bottom, and a top;

a shell cover joined to the shell; and whereby the shell selectively pivots about the lid shaft in an arcuate path between an open position and a closed position;

a variable linkage connected to the shell, the variable linkage having:

a shaft;

a crankshaft; and a cover seat receiving the lid shaft;

a drive motor comprising a rotatable output shaft, the drive motor being operable to rotate the rotatable output shaft;

a sensor being operatively connected to the drive motor, the sensor detecting a sensory motion near the lid portion, whereby the sensor activates the drive motor when a sensory motion is detected;

whereby, the output shaft rotates when the sensor detects motion;

a magnetic clutch receiving the output shaft, the magnetic clutch selectively engaging and disengaging the drive motor and the variable linkage, the magnetic clutch having:

a first magnet positioned in a magnet front seat;

a second magnet positioned in a magnet rear seat;

an elastic seat; and a rotatable shaft extending from the elastic seat, the magnets and the elastic seat being coaxially arranged in a coaxial configuration, whereby the magnets are releasable from the seats to magnetically attract;

a spring defined by two ends, the ends of the spring being inserted into the magnet rear seat and the elastic seat, respectively, whereby the spring helps absorb axial and rotational forces applied to the magnetic clutch;

whereby, rotation of the output shaft releases the first magnet from the magnet front seat, and releases the second magnet from the magnet rear seat, thereby causing the first and second magnets to draw together, thereby causing the elastic seat to be axially displaced towards the output shaft, thereby causing the rotatable shaft extending from the elastic seat to engage the crankshaft, thereby causing the crankshaft to convert the axial displacement along the magnetic clutch to a rotational motion against the lid shaft, thereby causing the lid shaft to pivot the shell to the open position;

whereby the spring helps reduce an axial force from the displacement of the elastic seat towards the output shaft; and whereby, cessation of rotation by the output shaft engages the first magnet to rest in the magnet front seat, and engages the second magnet to rest in the magnet rear seat, thereby causing the first and second magnets to withdraw, thereby causing the elastic seat to be axially displaced away from the output shaft, thereby causing the rotatable shaft extending from the elastic seat to disengage the crankshaft, thereby causing the lid shaft to release the shell to the closed position.

2. The assembly of claim 1, wherein the magnet front seat is clamped to the output shaft of the drive motor.

3. The assembly of claim 2, wherein the elastic seat is fixedly joined to a first column on the bottom of the shell.

4. The assembly of claim 3, wherein the first magnet is embedded in a first cavity of the magnet front seat.

5. The assembly of claim 4, wherein the second magnet is embedded in a second cavity of the magnet rear seat.

6. The assembly of claim 5, wherein the drive motor is fixed in the third column on the bottom of the shell through at least one screw.

7. The assembly of claim 6, wherein the output shaft of the drive motor is sleeved with the magnet front seat, the first magnet, the second magnet, the magnet rear seat, and the spring.

8. The assembly of claim 7, wherein the output shaft is defined by an outer end, the outer end being screwed into the elastic seat, wherein the magnet front seat is fixed with the output shaft.

9. The assembly of claim 8, wherein the lid shaft is disposed to insert into the cover seat.

10. The assembly of claim 9, wherein the elastic seat is fixed by the at least one screw to a first column on the bottom of the shell.

11. The assembly of claim 10, wherein the shell cover is screwed to the shell by the lid shaft.

12. The assembly of claim 11, wherein two ends of the lid shaft are inserted into a left cover sleeve and a right cover sleeve.

13. The assembly of claim 12, wherein the left cover sleeve is defined by a left vertical side and a left lateral side, and the right cover sleeve is defined by a right vertical side and a right lateral side, the vertical sides are inserted into multiple slots in the shell.

14. The assembly of claim 13, wherein the left cover sleeve and the right lateral side of the right cover sleeve are fixed by screws in a second column on the bottom of the shell.

15. The assembly of claim 14, wherein the first magnet is clamped to a front seat post on an inner wall of the magnet front seat through a first gap.

16. The assembly of claim 15, wherein the second magnet is clamped to a back seat post on an inner wall of the magnet rear seat through a second gap.

17. The assembly of claim 16, further comprising a motor and a speed reducer connected to the output shaft.

18. A magnetic drive intelligent trash bin lid assembly, the assembly comprising:

a lid portion having:

a shell having a lid shaft, a bottom, and a top;

a shell cover joined to the shell; and whereby the shell selectively pivots about the lid shaft in an arcuate path between an open position and a closed position relative to a container portion;

a variable linkage connected to the shell, the variable linkage having:

a shaft;

a crankshaft; and a cover seat receiving the lid shaft;

a drive motor comprising a rotatable output shaft, the drive motor being operable to rotate the rotatable output shaft;

a motor connected to the output shaft;

a speed reducer connected to the output shaft;

a sensor being operatively connected to the drive motor, the sensor detecting a sensory motion near the lid portion, whereby the sensor activates the drive motor when a sensory motion is detected;

whereby, the output shaft rotates when the sensor detects motion;

a magnetic clutch receiving the output shaft, the magnetic clutch selectively engaging and disengaging the drive motor and the variable linkage, the magnetic clutch having:

a first magnet positioned in a magnet front seat, the magnet front seat being clamped to the output shaft;

a second magnet positioned in a magnet rear seat;

an elastic seat, the elastic seat being fixedly joined to a first column on the bottom of the shell; and a rotatable shaft extending from the elastic seat, the magnets and the elastic seat being coaxially arranged in a coaxial configuration, whereby the magnets are releasable from the seats to magnetically attract;

a spring defined by two ends, the ends of the spring being inserted into the magnet rear seat and the elastic seat, respectively, whereby the spring helps absorb axial and rotational forces applied to the magnetic clutch;

whereby, rotation of the output shaft releases the first magnet from the magnet front seat, and releases the second magnet from the magnet rear seat, thereby causing the first and second magnets to draw together, thereby causing the elastic seat to be axially displaced towards the output shaft, thereby causing the rotatable shaft extending from the elastic seat to engage the crankshaft, thereby causing the crankshaft to convert the axial displacement along the magnetic clutch to a rotational motion against the lid shaft, thereby causing the lid shaft to pivot the shell to the open position;

whereby the spring helps reduce an axial force from the displacement of the elastic seat towards the output shaft; and whereby, cessation of rotation by the output shaft engages the first magnet to rest in the magnet front seat, and engages the second magnet to rest in the magnet rear seat, thereby causing the first and second magnets to withdraw, thereby causing the elastic seat to be axially displaced away from the output shaft, thereby causing the rotatable shaft extending from the elastic seat to disengage the crankshaft, thereby causing the lid shaft to release the shell to the closed position.

19. The assembly of claim 18, wherein the lid shaft is disposed to insert into the cover seat.

20. A magnetic drive intelligent trash bin lid assembly, the assembly consisting of:

a lid portion having:

a shell having a lid shaft, a bottom, and a top;

a shell cover joined to the shell; and whereby the shell selectively pivots about the lid shaft in an arcuate path between an open position and a closed position relative to a container portion;

a variable linkage connected to the shell, the variable linkage having:

a shaft;

a crankshaft; and a cover seat receiving the lid shaft;

a drive motor comprising a rotatable output shaft, the drive motor being operable to rotate the rotatable output shaft, the output shaft being defined by an outer end;

a motor connected to the output shaft;

a speed reducer connected to the output shaft;

a sensor being operatively connected to the drive motor, the sensor detecting a sensory motion near the lid portion, whereby the sensor activates the drive motor when a sensory motion is detected;

whereby, the output shaft rotates when the sensor detects motion;

a magnetic clutch receiving the output shaft, the magnetic clutch selectively engaging and disengaging the drive motor and the variable linkage, the magnetic clutch having:

a first magnet positioned in a magnet front seat, the magnet front seat being clamped to the output shaft, the first magnet being clamped to a front seat post on an inner wall of the magnet front seat through a first gap;

a second magnet positioned in a magnet rear seat, the second magnet being clamped to a back seat post on an inner wall of the magnet rear seat through a second gap;

an elastic seat, the elastic seat being fixedly joined to a first column on the bottom of the shell, the outer end of the output shaft being screwed into the elastic seat, wherein the magnet front seat is fixed with the output shaft; and a rotatable shaft extending from the elastic seat, the magnets and the elastic seat being coaxially arranged in a coaxial configuration, whereby the magnets are releasable from the seats to magnetically attract;

a spring defined by two ends, the ends of the spring being inserted into the magnet rear seat and the elastic seat, respectively, whereby the spring helps absorb axial and rotational forces applied to the magnetic clutch;

whereby, rotation of the output shaft releases the first magnet from the magnet front seat, and releases the second magnet from the magnet rear seat, thereby causing the first and second magnets to draw together, thereby causing the elastic seat to be axially displaced towards the output shaft, thereby causing the rotatable shaft extending from the elastic seat to engage the crankshaft, thereby causing the crankshaft to convert the axial displacement along the magnetic clutch to a rotational motion against the lid shaft, thereby causing the lid shaft to pivot the shell to the open position;

whereby the spring helps reduce an axial force from the displacement of the elastic seat towards the output shaft; and whereby, cessation of rotation by the output shaft engages the first magnet to rest in the magnet front seat, and engages the second magnet to rest in the magnet rear seat, thereby causing the first and second magnets to withdraw, thereby causing the elastic seat to be axially displaced away from the output shaft, thereby causing the rotatable shaft extending from the elastic seat to disengage the crankshaft, thereby causing the lid shaft to release the shell to the closed position.

* * * * *